US010145222B2

(12) United States Patent
Bowen et al.

(10) Patent No.: US 10,145,222 B2
(45) Date of Patent: Dec. 4, 2018

(54) OVER-COUPLING SCREEN COMMUNICATION SYSTEM

(71) Applicant: Superior Energy Services, LLC, Harvey, LA (US)

(72) Inventors: Eddie Glenn Bowen, Porter, TX (US); Kevin Andrew Smith, Klein, TX (US); Anthony Thomas, Houston, TX (US)

(73) Assignee: Superior Energy Services, LLC, Harvey, LA (US)

( * ) Notice: Subject to any disclaimer, the term of this patent is extended or adjusted under 35 U.S.C. 154(b) by 630 days.

(21) Appl. No.: 14/702,291

(22) Filed: May 1, 2015

(65) Prior Publication Data

US 2015/0315881 A1 Nov. 5, 2015

Related U.S. Application Data

(60) Provisional application No. 61/987,798, filed on May 2, 2014.

(51) Int. Cl.
*E21B 43/08* (2006.01)
*E21B 17/042* (2006.01)
*E21B 34/12* (2006.01)

(52) U.S. Cl.
CPC ..... *E21B 43/086* (2013.01); *E21B 43/084* (2013.01)

(58) Field of Classification Search
CPC ..... E21B 43/084; E21B 43/086; E21B 2034/007; E21B 43/08
See application file for complete search history.

(56) References Cited

U.S. PATENT DOCUMENTS

| | | | |
|---|---|---|---|
| 4,416,331 | A | 11/1983 | Lilly |
| 4,509,600 | A | 4/1985 | Boudreaux et al. |
| 4,770,336 | A | 9/1988 | Arterbury |
| 5,318,119 | A | 6/1994 | Lowry et al. |
| 5,341,880 | A | 8/1994 | Thorstensen et al. |
| 5,787,980 | A | 8/1998 | Sparlin et al. |
| 5,868,200 | A | 2/1999 | Bryant et al. |
| 5,881,809 | A | 3/1999 | Gillespie et al. |
| 6,158,507 | A | 12/2000 | Rouse et al. |
| 6,405,800 | B1 | 6/2002 | Walker et al. |
| 6,409,219 | B1 | 6/2002 | Broome et al. |

(Continued)

FOREIGN PATENT DOCUMENTS

| | | | |
|---|---|---|---|
| CA | 2875073 | A1 | 12/2013 |
| WO | 2014062180 | A1 | 4/2014 |

OTHER PUBLICATIONS

PCT Application No. US2015/28894; International Search Report and Written Opinion of the International Searching Authority for Applicant Superior Energy Services, LLC dated Sep. 30, 2015.

(Continued)

*Primary Examiner* — James G Sayre
(74) *Attorney, Agent, or Firm* — Jones Walker LLP

(57) ABSTRACT

A screen system having a first screen sub including a first base pipe wrapped with a first screen section; a second screen sub including a second base pipe wrapped with a second screen section; and a pipe coupling assembly joining the first and second base pipes. A section of filter material extends between the first and second screen sections, and extends over the pipe coupling assembly, thereby forming an annular flow path from the first screen section to the second screen section over the pipe coupling assembly.

19 Claims, 8 Drawing Sheets

(56) References Cited

U.S. PATENT DOCUMENTS

| | | | | |
|---|---|---|---|---|
| 6,530,431 | B1 | 3/2003 | Castano-Mears et al. | |
| 6,581,689 | B2 | 6/2003 | Hailey, Jr. | |
| 6,719,051 | B2 | 4/2004 | Hailey, Jr. et al. | |
| 6,749,020 | B1 | 6/2004 | Knight | |
| 6,752,207 | B2 | 6/2004 | Danos et al. | |
| 6,805,202 | B2 | 10/2004 | Gillespie et al. | |
| 7,048,061 | B2 | 5/2006 | Bode et al. | |
| 7,055,598 | B2 | 6/2006 | Ross et al. | |
| 7,717,178 | B2 | 5/2010 | Gaudette et al. | |
| 7,987,909 | B2 | 8/2011 | Pineda et al. | |
| 8,225,863 | B2 | 7/2012 | Hammer et al. | |
| 8,522,867 | B2 | 9/2013 | Yeh et al. | |
| 9,010,417 | B2 | 4/2015 | Garcia et al. | |
| 2002/0189809 | A1 | 12/2002 | Nguyen et al. | |
| 2004/0163804 | A1 | 8/2004 | Bode et al. | |
| 2009/0095471 | A1 | 4/2009 | Guignard et al. | |
| 2011/0024105 | A1 | 2/2011 | Hammer et al. | |
| 2012/0090831 | A1* | 4/2012 | Weirich | E21B 34/14 166/205 |
| 2016/0376876 | A1 | 12/2016 | Provost | |

OTHER PUBLICATIONS

"Well Screens" brochure, Superior Energy Services.

* cited by examiner

OVER-COUPLING SCREEN COMMUNICATION SYSTEM

This application claims the benefit under 35 USC § 119(e) of U.S. Provisional Application Ser. No. 61/987,798, filed May 2, 2014.

BACKGROUND OF INVENTION

The present invention relates to filtering systems used in oil & gas wells. Many well operations involve the placement of material, often via a fluid slurry, in the gap between the well casing (or wellbore in an uncased well) and another tubular string (e.g., production tubing) within the casing or wellbore. Typically fluid from the slurry is returned to the surface through a filter mechanism or "screens" positioned along the tubular string. The screens are typically formed from attaching a filtering media to the tubular string. A conventional screen assembly (also sometimes referred to as a screen "sub" or "joint") typically comprises a perforated "base pipe" with a screen material positioned around, but spaced somewhat off of, the base pipe. When multiple screen subs are positioned adjacent to one another in the tubular string, the connection between the screen subs usually forms a discontinuity in the surface area available for filtration. In many applications, it is desirable to maximize the surface area available for infiltration.

SUMMARY OF SELECTION EMBODIMENTS

In order to maximize infiltration, the areas across each unit of screen where there is no filter media, considered blank sections of a screen assembly, many embodiments are preferably equipped with a filtering mechanism which enables dehydration of a gravel slurry pumped across the blank section and contribution to and from the reservoir via perforations in a cased hole and reservoir contact in an open hole.

In other embodiments, the invention is a screen system comprising a first screen sub including a first base pipe wrapped with a first screen section; a second screen sub including a second base pipe wrapped with a second screen section; and a pipe coupling assembly joining the first and second base pipes; and a section of filter material extending between the first and second screen sections, and extending over the pipe coupling assembly, thereby forming an annular flow path from the first screen section to the second screen section over the pipe coupling assembly.

The above paragraphs present a simplified summary of the presently disclosed subject matter in order to provide a basic understanding of some aspects thereof. The summary is not an exhaustive overview, nor is it intended to identify key or critical elements to delineate the scope of the subject matter claimed below. Its sole purpose is to present some concepts in a simplified form as a prelude to the more detailed description set forth below.

DETAILED DESCRIPTION

Figure 1B:
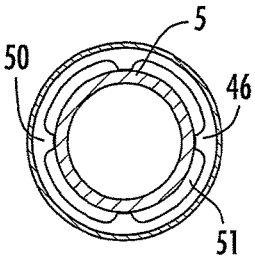
FIGS. 1A to 1C illustrate one embodiment of the present invention.
Figure 1C:
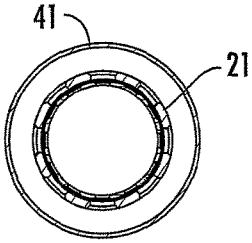
Figure 1A:
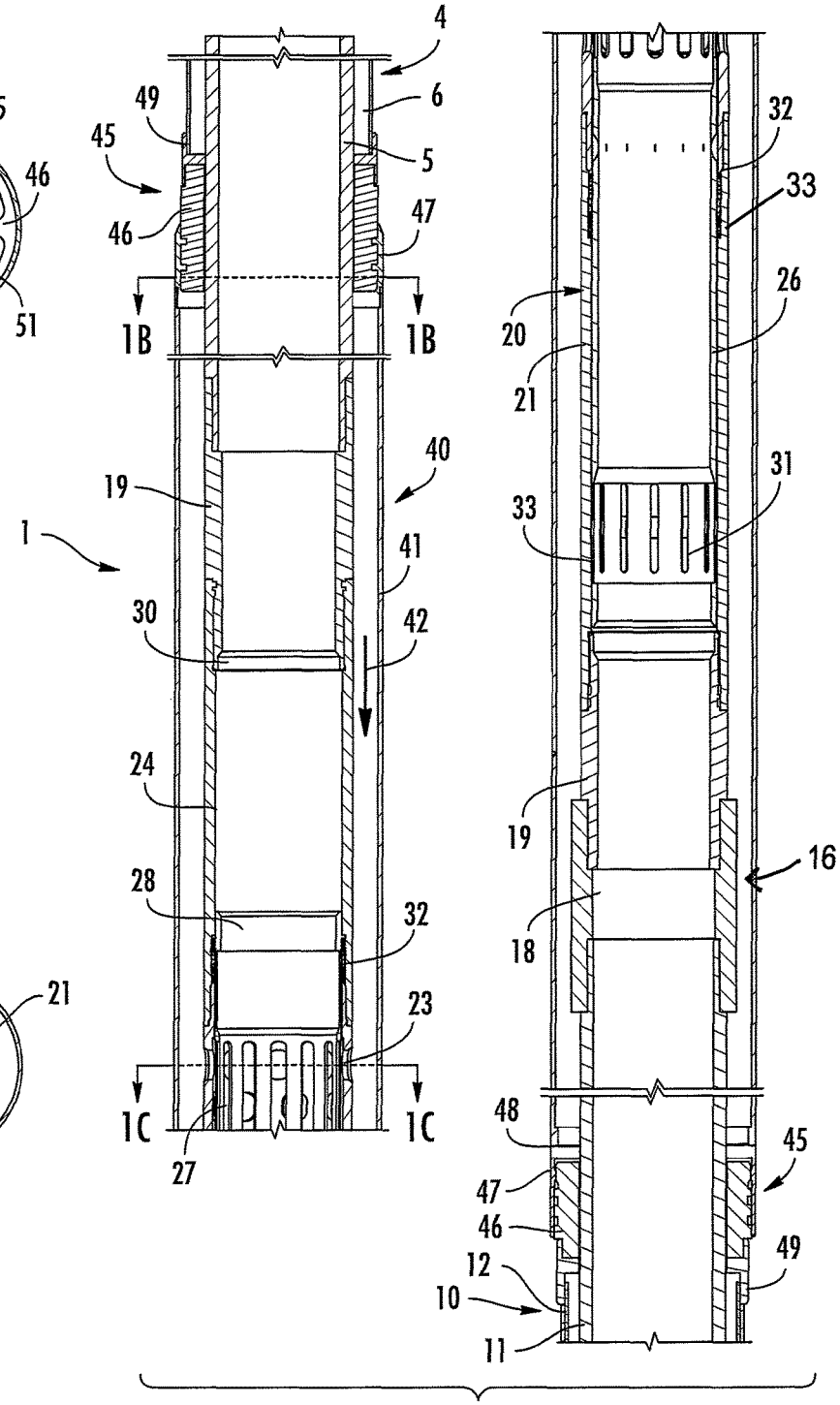

FIG. 1A illustrates one embodiment of the present invention, screen communication system or screen coupling system 1. In the most basic form, this embodiment of the screen communication system includes a first (or upper) screen sub 4, a second (or lower) screen sub 10, a pipe coupling assembly 16, and a section of filter material 40 extending between the screen subs 4 and 10. The first and second screen subs 4 and 10 generally comprise base pipes 5 and 11 and screen sections 6 and 12, respectively. FIG. 1A only illustrates the ends of screen subs 4 and 10 which are joined to pipe coupling assembly 16. In the FIG. 1A embodiment, base pipes 5 and 11 do not have inflow apertures along their length. Although not shown, it will be understood base pipes 5 and 11 could have one or more inflow valves, but certain other embodiments may have no inflow valves on base pipes 5 and 11. Typically, screen subs 4 and 10 could be any conventional or future developed screen system. Non-limiting examples of screen subs 4 and 10 may include the ProWeld™, Precision TOP, DynaFlo™, SlimFlo™, or Uniflo™ screen systems provided by the Completion Services division of Superior Energy Services, Inc. of Houston, Tex.

The components of pipe coupling assembly 16 may vary in different embodiments. In the FIG. 1A embodiment, coupling assembly 16 includes threaded base pipe coupling 18 which has internal threads engaging the external threads on base pipe 11 at one end and engaging valve connector sub 19 on the other end. In one example, any conventional thread type may be used to join base pipe 11 and base pipe coupling 18. Seen next in FIG. 1A, the opposite end of valve connector sub 19 threadedly engages the first end of valve body 21, which forms part of the overall valve assembly 20. The second end of valve body 21 engages valve body extension 24, which in turn engages a second valve connector sub 19. This second valve connector sub 19 then engages the base pipe 5 of screen sub 4. It will be understood that these components of coupling assembly 16 (including valve assembly 20) are all tubular in the sense that the coupling assembly 16 will form a continuous central flow path between base pipes 5 and 11.

Positioned within valve body 21 is sliding sleeve 26 which includes sleeve apertures 27 approximate the upper end (relative to the orientation of FIG. 1A) of the sliding sleeve 26. Valve body 21 will have corresponding body apertures 23 and seals 32 on each side of the body apertures 23. It will be readily apparent that a flow path between the interior and exterior of the valve assembly 20 may be establish and terminated by moving sleeve apertures 27 into and out of alignment with body apertures 23. In the sleeve position seen in FIG. 1A, sleeve apertures 27 and body apertures 23 are align such that valve assembly 20 is in the open position. Valve assembly 20 may be closed by sliding sleeve 26 toward screen sub 4 until sleeve 26 contacts sleeve stop 30, at which point sleeve apertures 27 are beyond seals 32 and cannot communicate with body apertures 23. In many embodiments, the sleeve valve is designed according to the "down-to-open/up-to-close" convention (where "up" is the direction coming out of the well), but naturally could be designed with the opposite opening/closing directions.

The end of sliding sleeve 26 opposite that having sleeve apertures 27 is illustrated as including a collet assembly 31. Collet assembly 31 may be a conventional set of collet fingers which engage collet profiles 33 formed on the inside surface of valve body 21. It will be understood that collet assembly 31 will releasably engage a collet profile 33 in both the open and closed position of sliding sleeve 26, thereby biasing sliding sleeve 26 in the open or closed position until sufficient force is applied to sliding sleeve 26 to force the collet fingers out of the collet profiles.

Figure 5A:
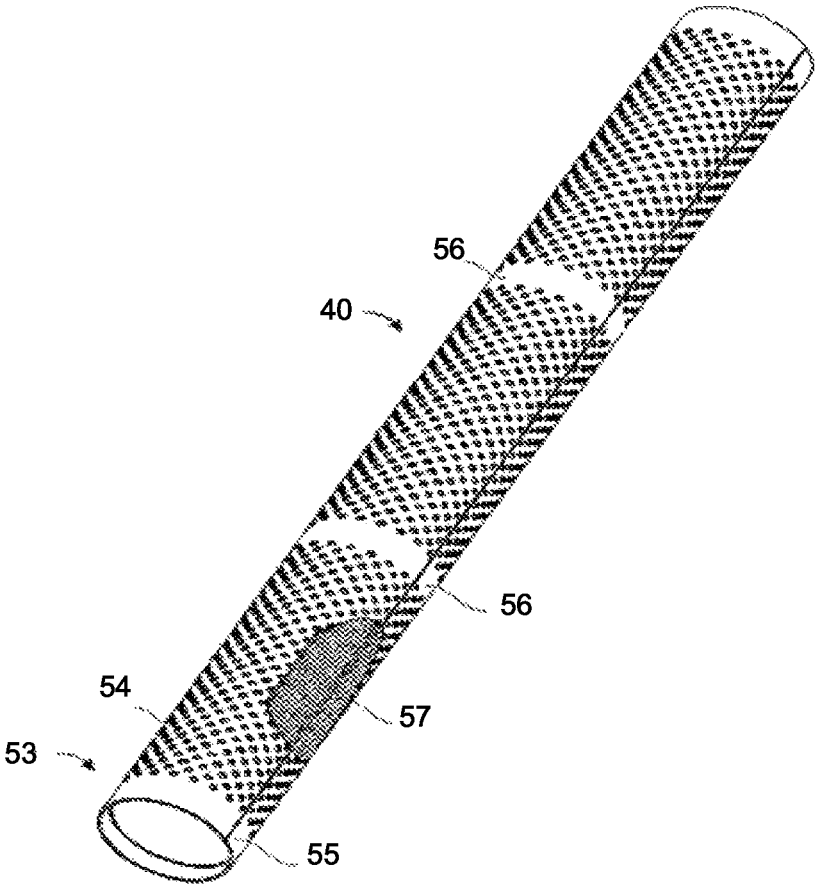
FIGS. 5A and 5B illustrate alternate embodiments of a screen material or filtration media.
Figure 5B:
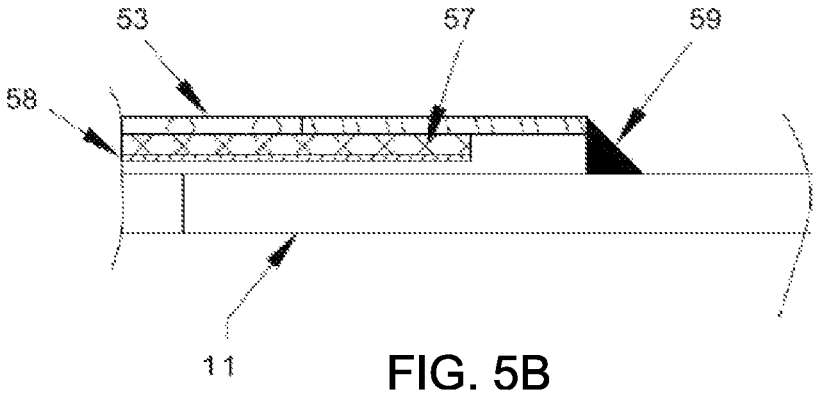

FIG. 1A further illustrates a section of filter material 40 extending between the first and second screen sections 6 and 12. The section of filter material 40 extends over the pipe coupling assembly 16 and thereby forms an annular flow path 42 from the first screen section 6 to the second screen section 12 over the pipe coupling assembly 16. Filter material 40 could be any number of materials sufficiently robust to withstand the downhole conditions which it will encounter and having sufficient filtering capacity to meet design criteria. For example, the filter material will often have an opening size or a mesh size based upon the distribution of sand grain sizes specific to the well in question. In certain embodiments, filter material 40 may be any conventional or future developed well screen structure. In the particular embodiment seen in FIG. 5A, filter material 40 forms a third screen section (between screen sections 6 and 12) which includes (i) a sheet metal section 53 with a plurality of apertures 54 formed in a tubular shape; and (ii) a screen or filter material 57 beneath the sheet metal section 53 and of a mesh size smaller than the sheet apertures 54, where the filter material 57 is diffusion bonded or sintered to the sheet metal section 53. Naturally, many other conventional or future developed connecting methods could be employed, e.g., gluing, resistance welding, ultrasonic welding, etc. FIG. 5B illustrates a slightly modified version of a filter material (i.e., screen assembly). FIG. 5B shows a partial cross-section where a base pipe 11 has an outer sheet metal section (or "outer shroud") 53 welded to base pipe 11 at point 59. This embodiment has a filter media layer 57 bonded to outer shroud 53 and a drainage layer 58 bonded to filter media 57. In one example, the filter layer is a square weave of metal wire where the openings in the weave are larger than those of the filter media layer (which is itself a tighter weave of metal wire). In FIG. 5B, a single drainage layer 58 is shown, but in alternative designs, a drainage layer may be positioned on both sides of the filter media layer.

The diffusion bonding technique is generally carried out by stacking a series of layers of metal, in one example, a filter media, a drainage layer, and a perforated shroud in a specific array. This array is then placed in a complete vacuum oven filled with an inert gas at elevated temperatures and pressures, causing the metals to be bonded together to create a very strong and robust unit as a single piece. As suggested in FIG. 5A, the sheet metal section 53 may be rolled in a cylinder shape and welded along seam 55. In this embodiment, the sheet metal apertures will often have a diameter ranging between about ¼" and ½", but can have diameters outside this range. Nor do the sheet metal apertures need to be round, but can take on any shape. In certain embodiments, such apertures will have a flow area (i.e., the opening into which fluid can flow) of between about 0.025 $in^2$ and about 1.0 $in^2$. In many embodiments, the ratio of apertures to sheet material will range between about 20% and 30%, but can less if more structural strength is necessary or greater if structural strength requirements are less demanding. The embodiment of FIG. 5A shows solid sections 56 (i.e., sections without apertures 54) to improve mechanical strength characteristics. The sheet metal (or "sheet material" if a non-metal) may be any material suitable for downhole conditions. In some instances conventional carbon steel, but more typically a stainless steel such as 304 or 316L SS in a thickness ranging from about 8 gauge to about 16 gauge.

As suggested above, the screen or filter material 57 will typically be sized based upon the distribution of sand grain sizes specific to the well in question. However, as non-limiting examples, in many embodiments the screen material will have an opening size ranging between about 125 um and about 500 um and providing an about 45% to about 60% flow area (of total surface area). Although the screen material may be formed of many compounds, two example materials are stainless steel 316L or Alloy 20. In many examples, the filter section is a woven wire material (e.g., a square weave or any of a number of other weave patterns), but could also be formed by many non-woven techniques. Naturally, alternative filter materials 40 could be formed of different materials and have size ranges outside those listed above, but still come within the scope of the present invention. An example of one suitable filter material may be found in U.S. application Ser. No. 14/031,269, filed Sep. 13, 2013, and entitled "Screen Filter," which is incorporated by reference herein in its entirety.

In the embodiment of FIG. 1A, the filter material 40 forms a connection to the screen subs' screen sections 6 and 12 by way of a screen coupler 45. This example of screen coupler 45 includes a shrink fit ring 49 securing the screen sections 6 and 12 to end rings 46. The threaded screen retainer 47, which was previously welded to filter material 40 (at weld point 48), is then threaded onto end ring 46. As suggested in FIG. 1B, end ring 46 includes an inner tubular section formed by the first base pipe 5 and an outer tubular section defining the annular flow passages 51 between the inner and outer tubular sections. FIG. 1B also illustrates how the end ring includes ribs 50 between the inner tubular and outer tubular sections and how the ribs 50 separate the annular flow passages.

As suggested in FIG. 1A, this embodiment of the filter material 40 extends substantially an entire length between the first and second screen sections, i.e., with the screen couplers 45 being the only filter material discontinuities between the screen filtering sections 6 and 12 and filter material 40. However, in alternate embodiments, the filter material may extend less than the entire length between the first and second screen sections, for example at least 80% (alternatively 70%, 60%, or 50%) of the length between the first and second screen sections.

Figure 3:
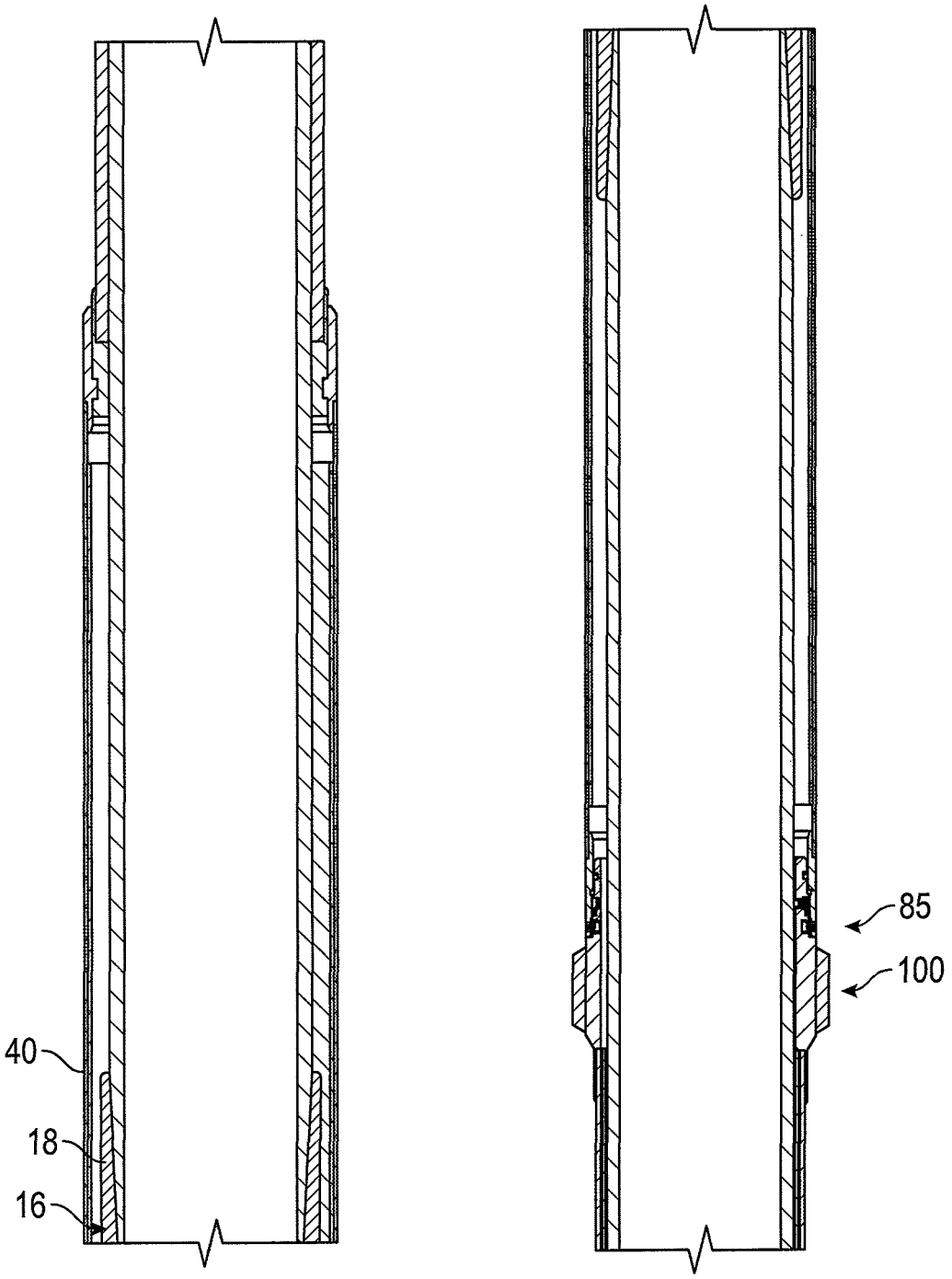
FIG. 3 illustrates an embodiment similar to FIG. 1A, but lacking a sleeve valve.

Although FIG. 1A illustrates the screen communication system as incorporating valve assembly 20, other embodiments could utilize simple continuous pipe sections having no valve structure. For example, FIG. 3 illustrates a screen communication system similar to that of FIG. 1A, but with no valve assembly 20. Instead, the pipe coupling assembly 16 consists entirely of threaded coupling 18. Additionally, this embodiment shows a centralizer 100 and rather than the threaded screen coupler 45, FIG. 3 shows a quick-connect coupling 85 which is explained in more detail below in reference to FIGS. 4A and 4B.

Figure 2B:
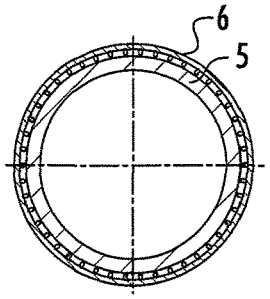
FIGS. 2A to 2C illustrate a second embodiment of the present invention.
Figure 2C:
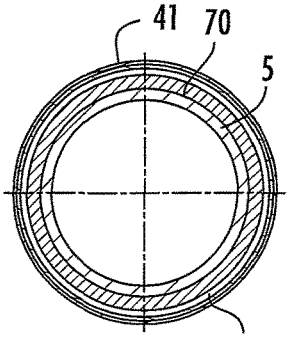
Figure 2A:
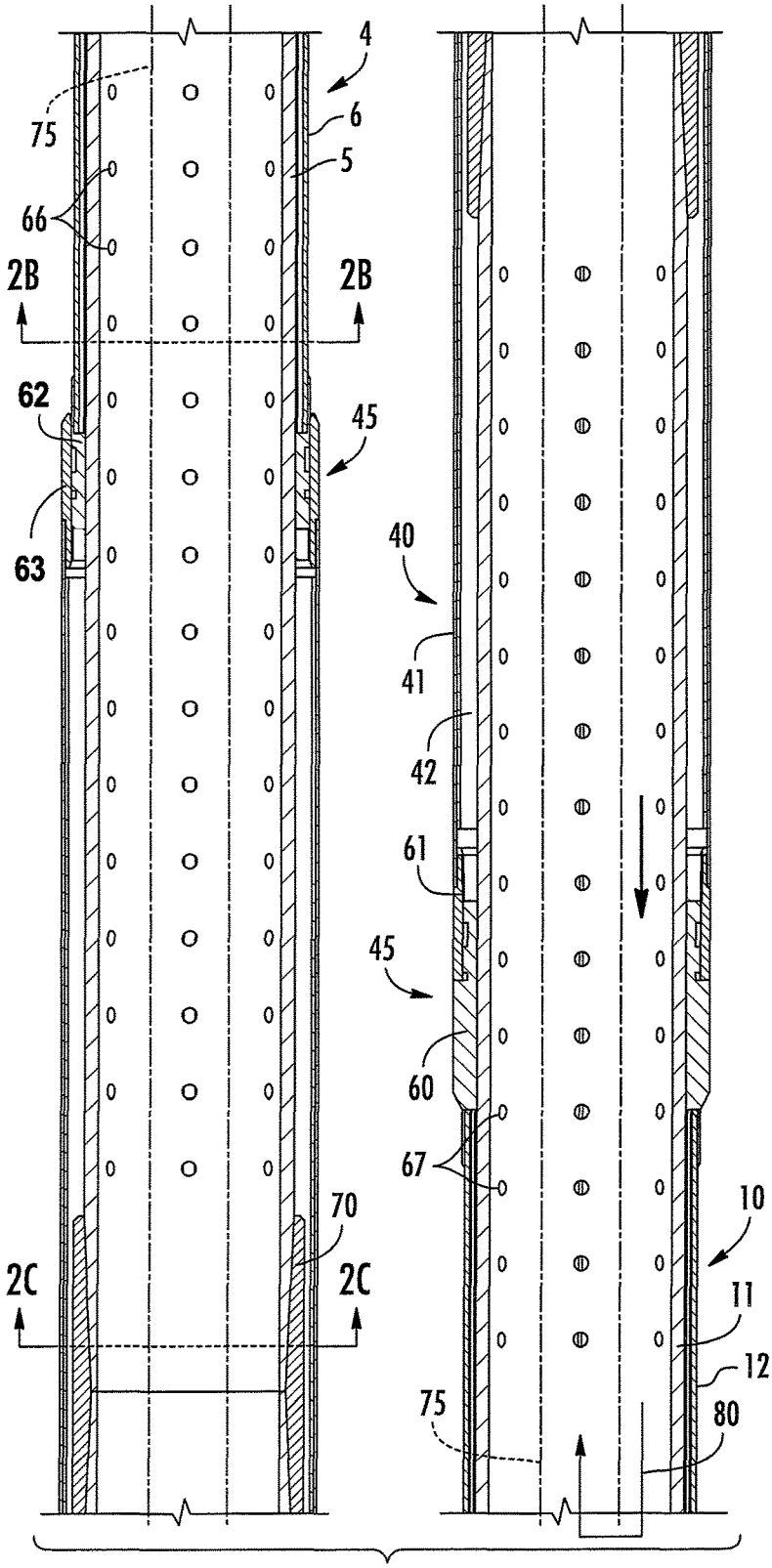

FIGS. 2A to 2C illustrate a second embodiment of the screen coupling system of the present invention. FIG. 2A shows the first and second screen subs 4 and 10 with their base pipes 5 and 11 extending to the base pipe coupler 70. The base pipes 5 and 11 are shown with a series of inflow apertures 66 and 67, respectively. Although not part of the screen coupling system, FIG. 2A also shows a conventional internal isolation string (wash pipe) 75 extending through base pipes 5 and 11. Wash pipe 75 is employed in one particular manner of using the screen coupling system as will be explained below.

The screen coupler 45 of the FIG. 2 embodiment has a more basic construction than that of the FIG. 1A embodiment. In FIG. 2A, upper screen coupler 45 is shown as constructed of primary screen retainer 62 and connecting screen retainer 63. Primary screen retainer 62 is heat shrunk to first screen section 6 and welded to first base pipe 5. Connecting screen retainer 63 is welded to filter material 40 and has inner threads which engage mating threads on the outer surface of primary screen retainer 62. FIG. 2B is a cross-section of first base pipe 5 and first screen section 6 illustrating the annular flow channels between the base pipe and screen section. FIG. 2A shows a modified lower screen coupler 45 with a somewhat different configuration of primary screen retainer 60 and connecting screen retainer 61. When the pipe is un-perforated and an inflow control device (ICD) or sliding sleeve is used to communicate the annular flow to the base pipe, there exists an axial flow path underneath the filter media. This fluid flow path is an annular flow area provided by the use of a structure supporting the filter layer and provides sufficiently large flow area such that the velocities underneath the filter media and un-perforated base pipe remain below erosion limits. FIG. 2C is a cross-section through base pipe coupler 70 illustrating the annular flow space 42 formed between base pipe coupler 70 and filter material 40 (e.g., third screen section or filter assembly 41).

As suggested above, in one example method of employing the screen coupling system of FIG. 2, the wash pipe 75 extends through base pipes 5 and 11 and provides a fluid return path. In various operations (e.g., gravel packing), fluid from the well bore annulus will be flowing though the screens of the screen subs 4 and 10 and also the section of filter material 40. This fluid will enter the base pipes and flow down (i.e., toward the low pressure end) along wash pipe 75 until reaching the end of (or other opening in) wash pipe 75 and beginning the return path to the surface. In instances where pressure distribution along the screen sections makes it advantageous to have a flow path around the screen coupling 45, the fluid path is formed by fluid entering (for example) through the filter assembly 41, flowing past the coupling in the annular space between the base pipe and wash pipe 75, and then entering wash pipe 75 as suggested by flow path 80.

In many embodiments, the connection between the screen subs (both upper and lower screen subs 4 and 10) and the section of filter material or media 40 will be by a conventional threaded means. For example, in the FIG. 2 embodiment, the connecting screen retainer has internal threads which engage and thread onto external threads on primary screen retainer 60. However, FIG. 4A suggests one quick-connect mechanism or assembly 85 which joins the upper and lower screen subs 4 and 10 to the section of filter material 40 without rotation (or substantially no rotation, e.g., less than one revolution). The illustrated embodiment of quick-connect assembly 85 (also sometimes referred to as a "linear movement connector") generally includes an attachment ring 92 heat shrunk to filter material 40 and a screen end ring 90 welded to the lower screen section 12 of lower screen sub 10. The portion of screen end ring 90 most proximate to filter material 40 will have an outer diameter which allows it slide within the inner diameter of attachment ring 92. This portion of screen end ring 90 will also have a lock ring channel 91 sized to accommodate the body lock ring 89. In one embodiment, body lock ring 89 is less than a full ring section, thereby allowing the ring to compress slightly and marginally reduce its diameter. Body lock ring 89 is also preferably formed of a material giving it a spring bias toward the expanded (wider diameter) state. In the example embodiment of FIG. 3, the quick-connect assembly 85 is only used at the lower connection point of filter material 40 and the upper connection point is made simply using a set screw with a debris barrier.

Figure 4A:
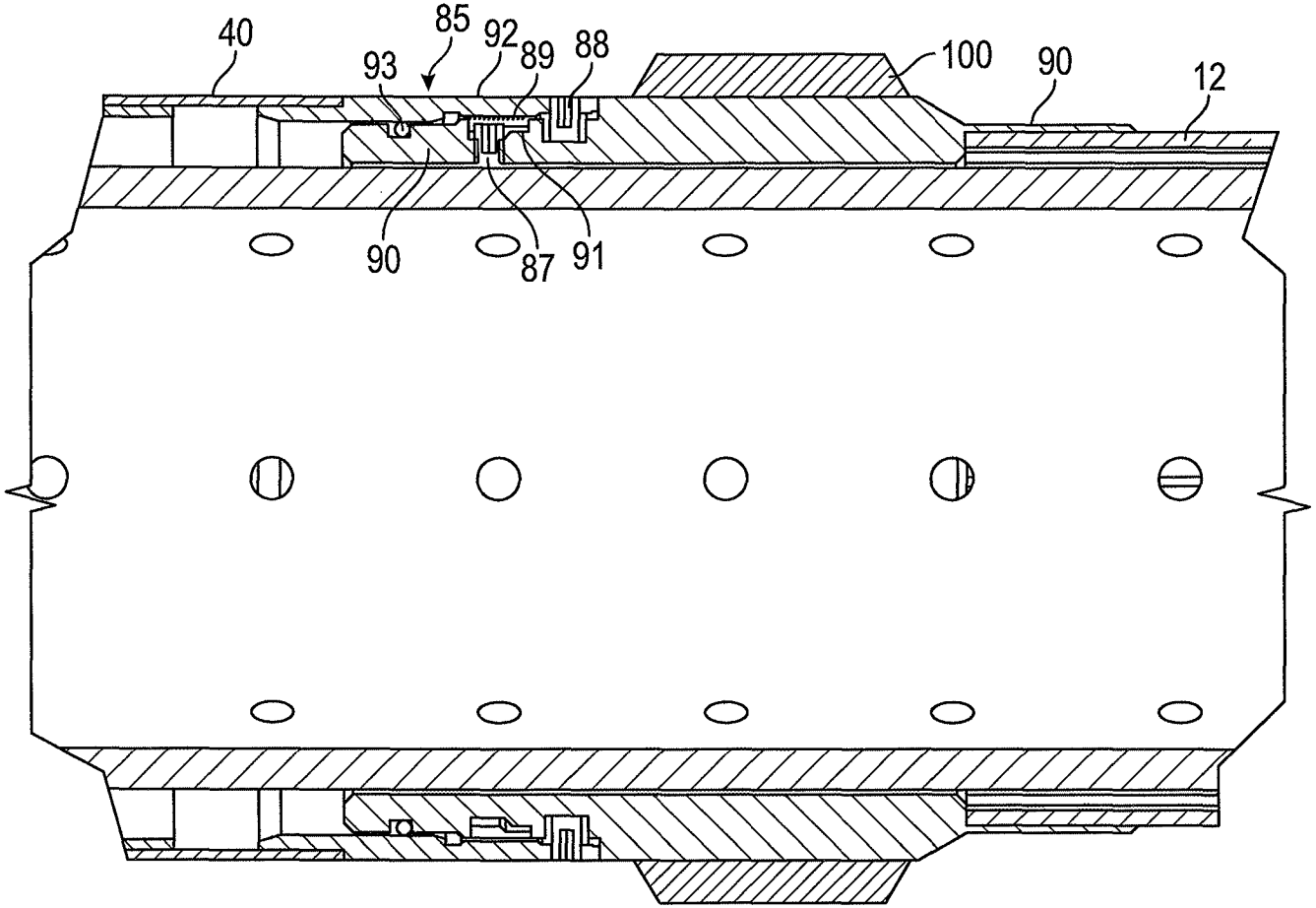
FIGS. 4A and 4B illustrate embodiments of a quick-connect assembly.

Formed on the outer surface of body lock ring 89 will be a series of ratchet teeth having surfaces sloped away from attachment ring 92 and opposing vertical surfaces. A set screw (or other set member) 87 acts to prevent body lock ring 89 from rotating in lock ring channel 91. FIG. 4A also shows how a corresponding, but oppositely orient series of ratchet teeth are formed on the inner surface of attachment ring 92. In this embodiment, the opposing pair of ratchet teeth also have a standard thread inclination, thereby allowing relative rotation between screen end-ring 90 and attachment ring 92 to cause these elements to engage and disengage. It may be visualized how, prior to assembly, screen end-ring 90 and attachment ring 92 are separated. In order to join these elements, attachment ring 92 is inserted over screen end ring 90 and their respective ratchet teeth forced to engage. Since body lock ring 89 has the capacity to marginally decrease its diameter and since the sloped surfaces of the ratchet teeth face one another, the ratchet teeth can slide past one another until screen end-ring 90 and attachment ring 92 are fully engaged and a seal formed by o-ring 93. Now, any separating force acting on screen end-ring 90 and attachment ring 92 will be resisted by the vertical surfaces of the ratchet teeth and the tendency of body lock ring 89 to expand. It can be understood how quick-connect assembly 85 may be considered a linear movement connector since it allows for connection of the screen end-ring and the screen attachment ring without rotative motion (i.e., conventional threaded connections).

In the FIG. 4A embodiment, a second set screw 88 is positioned to engage screen end-ring 90 and attachment ring 92 in order to prevent relative rotation between these components. It will be understood that when second set screw 88 is removed, relative rotation of screen end-ring 90 and attachment ring 92 will allow these elements to again be separated even though the ratchet teeth would otherwise resist movement in the linear direction. FIG. 4A also illustrates how screen end ring 90 will include a centralizer 100 formed by a series of centralizer fins positioned around the perimeter of screen end ring 90.

Figure 4B:
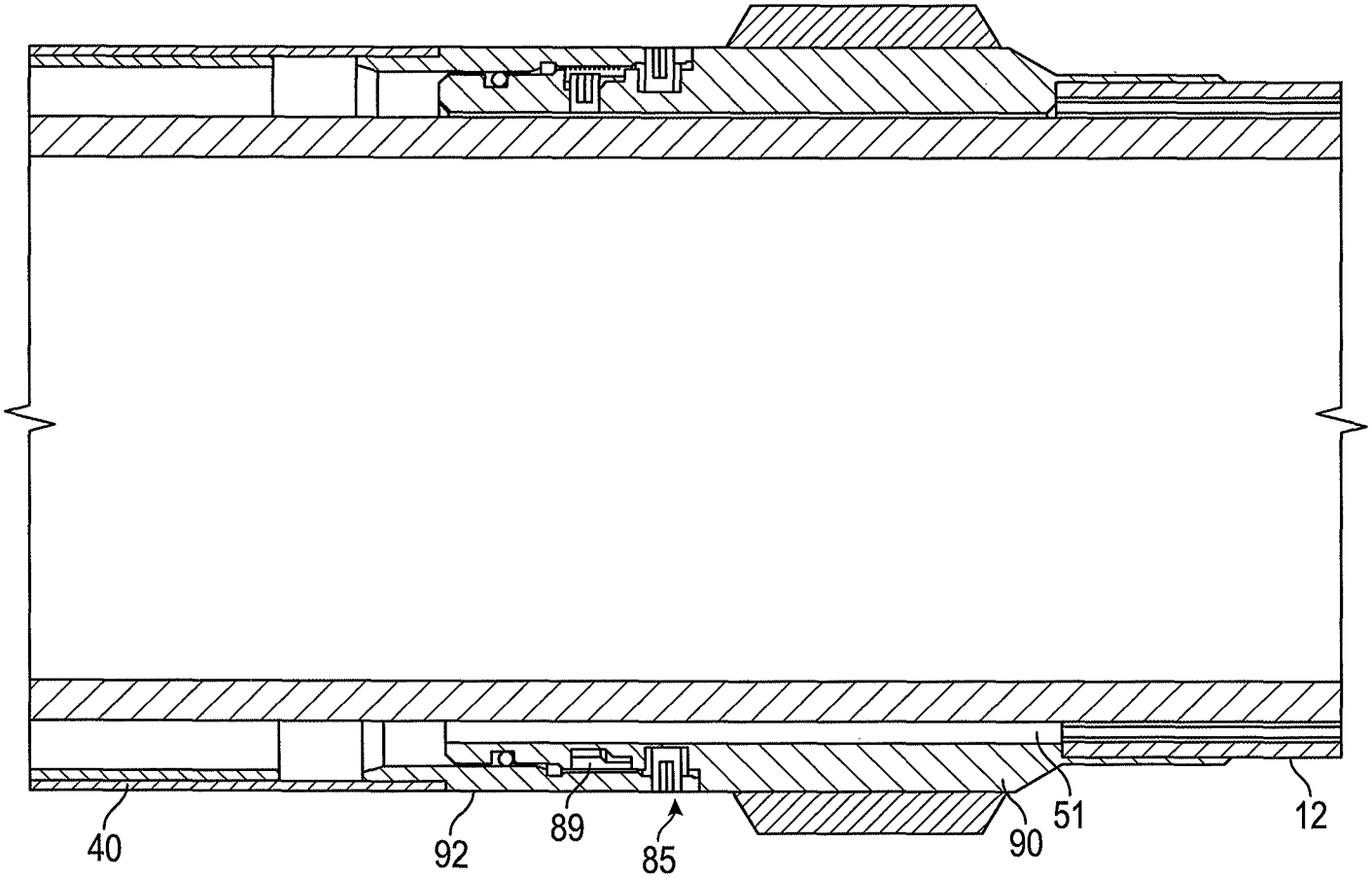

FIG. 4B illustrates a slightly modified embodiment of the quick-connect assembly 85. This version the quick-connect assembly has the components seen in FIG. 4A, including screen end-ring 90, attachment ring 92, and body lock ring 89. However, this quick-connect assembly 85 further includes the flow path or flow channel 51, thereby allowing fluid to pass directly through quick-connect assembly 85 from the flow annulus under screen 12 to the flow annulus under filter material 40. The flow channel 51 allows this embodiment of quick-connect assembly 85 to provide a suitable connector for use in the embodiment of FIG. 1A.

Figure 6C:
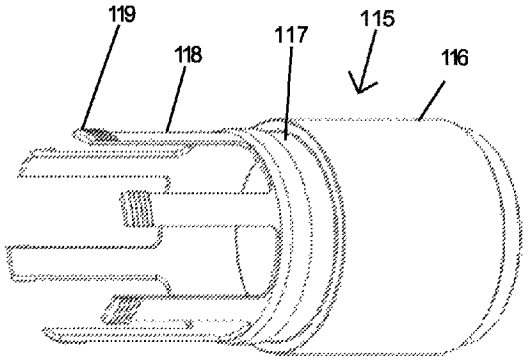
FIGS. 6A to 6C illustrate a third embodiment of a quick-connect assembly.
Figure 6B:
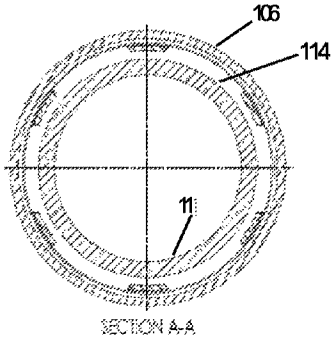
Figure 6A:
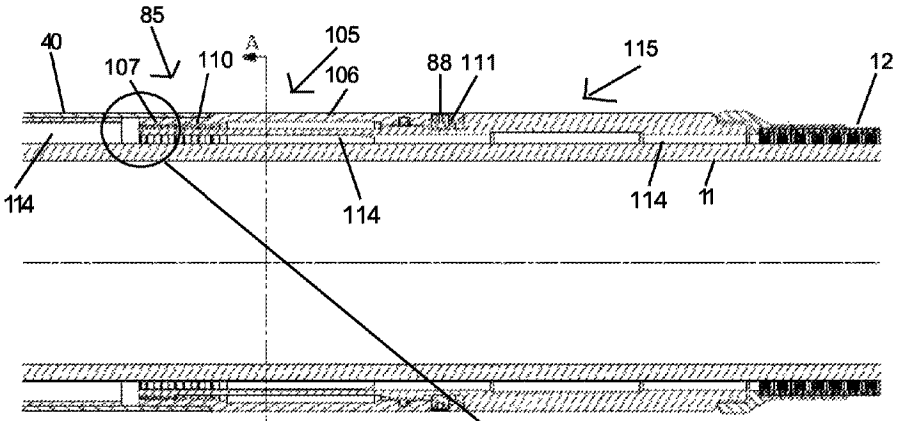
Figure 6A:
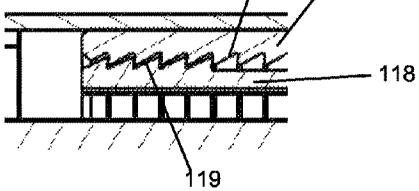

FIGS. 6A to 6C illustrate a third embodiment of a quick-connect assembly 85 (or a "linear movement connector"). In FIG. 6A, the female coupler assembly 105 includes outer body 106 which is welded to filter material 40 at weld point 107. Female coupler assembly 105 may be considered one embodiment of a screen attachment ring. Formed on the inner surface of outer body 106 (facing inward toward base pipe 11) are a series of female buttress threads, i.e., sawtooth threads, 110. The detail associated with FIG. 6A illustrates how the buttress threads have an inclined surface on one side and a vertical surface on the other side, i.e., vertical in the sense of being perpendicular to the inner surface of outer body 106 on which the threads are formed. The female coupler assembly 105 engages the male coupler assembly 115, which is illustrated in the cross-section of FIG. 6A and the perspective view of FIG. 6C. Male coupler assembly 115 includes body section 116 which is connected on one end to the screen section 12. Male coupler assembly 115 may be considered one embodiment of a screen end ring. The opposite end of body section 116 terminates with the engagement groove 117 and a series of finger sections 118 extending beyond engagement groove 117. The outer surface on the ends of finger sections 118 will include the male buttress threads 119. Like the female buttress threads 110, the male buttress threads 119 have opposing inclined and vertical surfaces. It can be seen how male buttress threads and female buttress threads form a pair of opposing ratchet teeth.

Viewing FIG. 6A, it may be envisioned how the separated male coupler assembly 115 will slide into engagement with the female coupler assembly 105. When a force in the direction of combining the coupler assemblies causes the male buttress threads 119 encounter the female buttress threads 105, the inclined surfaces will move past one another, allowing the two coupler assemblies to inter-lock. However, axial force in the direction separating the coupler assemblies will cause the vertical surfaces of the buttress threads to engage and resist such force. The movement of male coupler assembly 115 into female coupler assembly 105 is limited by the engagement shoulder 111 on outer body 106 dropping into engagement groove 117 on male coupler assembly 115. FIG. 6A also shows the set screw 88 passing though outer body 106 and engaging main body 116 to prevent their relative rotation. As is well understood in the art, while buttress threads 110 and 119 resist an axial disengaging force, relative rotation between the two coupler assemblies will allow threads 110 and 119 to disengage. As seen in FIGS. 6A and 6B, this configuration creates a continuous passage 114 which allows fluid to pass through the male and female coupler assemblies from one screen area to another.

Figure 7C:
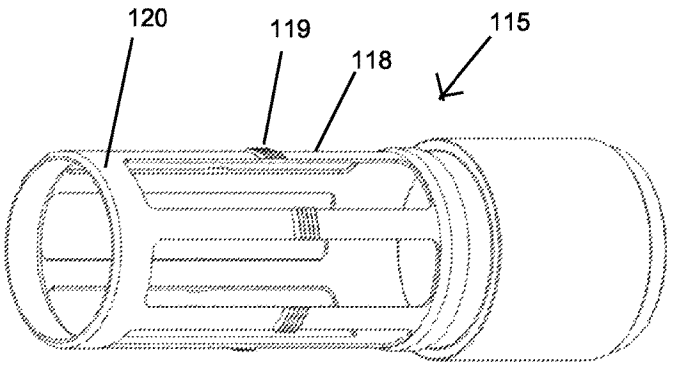
FIGS. 7A to 7C illustrate a fourth embodiment of a quick-connect assembly.
Figure 7B:
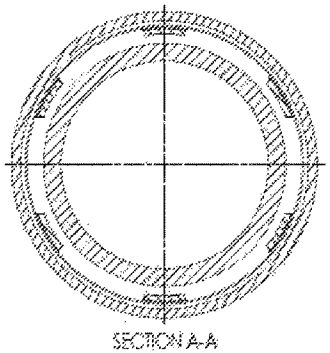
Figure 7A:
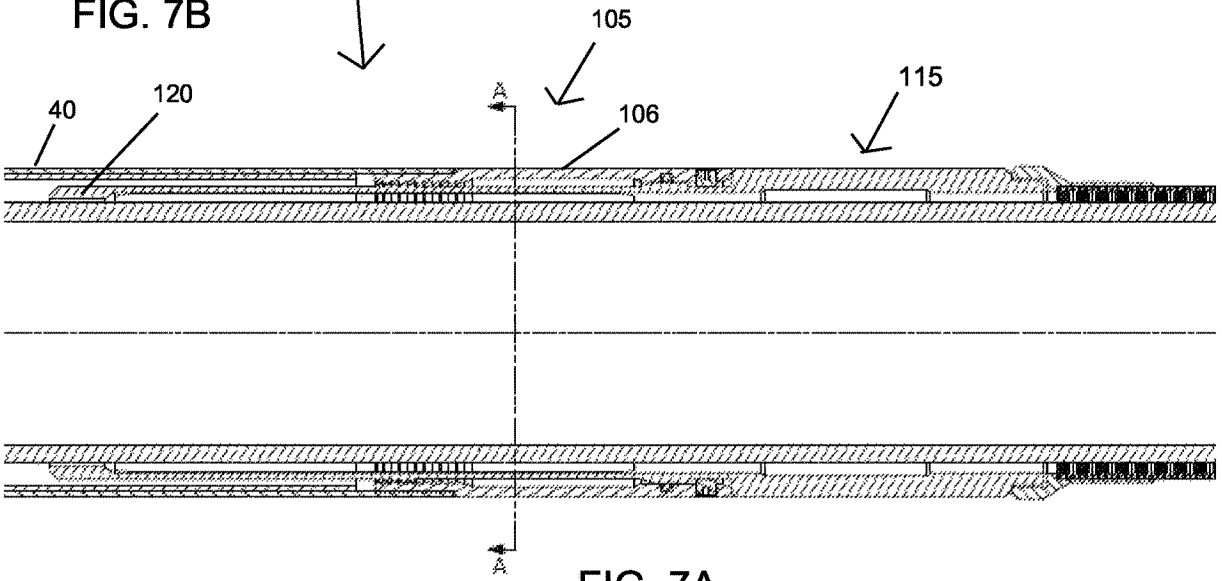

FIGS. 7A to 7C illustrate a slightly modified embodiment to that seen in FIGS. 6A to 6C. Like the FIG. 6 embodiment, FIG. 7A shows male coupler assembly 115 engaging female coupler assembly 105. The main difference in the FIG. 7 embodiment is that the male coupler assembly 115 as best seen in FIG. 7C. This version of male coupler assembly 115 includes the closed ring section 120 formed at the ends of fingers 118. The closed ring section 120 holds the individual fingers 118 rigidly in place and acts to prevent the bending of fingers 118 from careless handling or assembly. Such bending or other damage is a greater possibility when employing the open ended or "cantilevered" fingers 118 seen in FIG. 6C. The closed ring section 120 of FIG. 7C creates a "beam" configuration where the fingers are supported at both of their ends.

Although the invention has been described in terms of certain specific embodiments, those skilled in the art will readily recognize many obvious modification and variations thereof. All such modifications and variations are intended to come within the scope of the following claims.

The invention claimed is:

1. A screen system comprising:

a. a first screen sub including a first base pipe wrapped with a first screen section;

b. a second screen sub including a second base pipe wrapped with a second screen section;

c. a pipe coupling assembly joining the first and second base pipes;

d. a section of filter material extending between the first and second screen sections, and extending over the pipe coupling assembly, thereby forming an annular flow path between the first screen section and the second screen section over the pipe coupling assembly; and e. an end ring including annular flow passages connecting the first screen section to the section of filter material.

2. The screen system according to claim 1, wherein the filter material extends substantially an entire length between the first and second screen sections.

3. The screen system according to claim 2, wherein the filter material extends at least 80% of the length between the first and second screen sections.

4. The screen system according to claim 1, wherein the end ring positioned on the base pipe provides an inner tubular section for maintaining fluid communication with the first base pipe and an outer tubular section defining the annular flow passages between the inner and outer tubular sections.

5. The screen system according to claim 4, wherein the end ring includes ribs between the inner tubular and outer tubular sections and the ribs separate the annular flow passages.

6. The screen system according to claim 1, wherein the end ring has an external connector surface and a screen retainer on the section of filter material has an internal connector surface engaging the external connector surface.

7. The screen system according to claim 6, wherein the external and internal connector surfaces are mating threaded surfaces.

8. A screen system comprising:

a. a first screen sub including a first base pipe wrapped with a first screen section;

b. a second screen sub including a second base pipe wrapped with a second screen section;

c. a pipe coupling assembly joining the first and second base pipes, wherein the pipe coupling assembly includes (i) at least one fluid aperture allowing flow from an annular flow path around the coupling assembly into a central flow passage extending through the coupling assembly; and (ii) a valve for opening and closing the at least one aperture; and d. a section of material extending between the first and second screen sections, and extending over the pipe coupling assembly, thereby forming the annular flow path extending from the first screen section to the second screen section over the pipe coupling assembly.

9. The screen system according to claim 6, wherein the valve is a sliding sleeve disposed within the coupling assembly.

10. The screen system according to claim 8, wherein the material is a third screen section.

11. The screen system according to claim 10, wherein the third screen section includes (i) a sheet metal section with a plurality of apertures formed in a tubular shape; and (ii) a screen material of a mesh size smaller than the sheet apertures, the screen portion being diffusion bonded to the sheet metal section.

12. The screen system according to claim 11, wherein the sheet metal apertures have an open area ranging between about 0.025 and about 1 square inches.

13. The screen system according to claim 12, wherein the screen material has a mesh size ranging between about 125 μm and about 500 μm.

14. A screen system comprising:

a. a first screen sub including a first base pipe with apertures formed therein and wrapped with a first screen section;

b. a second screen sub including a second base pipe with apertures formed therein and wrapped with a second screen section;

c. a pipe coupling assembly joining the first and second base pipes;

d. a section of filter material extending between the first and second screen sections, and extending over the pipe coupling assembly; and e. first and second screen couplers coupling the section of filter material to the first and second base pipes respectively, wherein (i) the couplers are positioned with base pipe apertures on each side of the couplers, and (ii) the couplers prevent flow through the couplers.

15. A screen system comprising:

a. a first screen sub including a first base pipe wrapped with a first screen section;

b. a second screen sub including a second base pipe wrapped with a second screen section;

c. a pipe coupling assembly joining the first and second base pipes;

d. a section of material extending between the first and second screen sections, and extending over the pipe coupling assembly, thereby forming an annular flow path from the first screen section to the second screen section over the pipe coupling assembly;

e. a screen end-ring connected to the first screen section, both the screen end-ring and the first screen section extending at least partially over the first base pipe;

f. a screen attachment ring connected to the section of material; and g. a linear movement connector allowing connection of the screen end-ring and the screen attachment ring without substantial rotative motion.

16. The screen system assembly of claim 15, further comprising a pair of opposing ratchet teeth positioned between the screen end-ring and the screen attachment ring, the opposing ratchet teeth allowing linear movement of the end-ring and the attachment ring towards one another, but resisting linear movement of the end-ring and the attachment ring away from one another.

17. The screen system assembly of claim 16, wherein one of the pair of opposing ratchet teeth is positioned on the screen end-ring.

18. The screen system assembly of claim 17, wherein the opposing ratchet teeth on the screen end-ring are formed on a separate lock-ring substantially encircling the end-ring.

19. The screen system assembly of claim 18, wherein the lock-ring has a diameter which compresses sufficiently to allow one-direction movement of the opposing ratchet teeth on the attachment ring.

* * * * *